US005644217A

United States Patent [19]

Kusaba

[11] Patent Number: 5,644,217

[45] Date of Patent: Jul. 1, 1997

[54] EMITTER COUPLED LOGIC OUTPUT CIRCUIT

[75] Inventor: Katsumi Kusaba, Kyoto, Japan

[73] Assignee: Rohm Co., Ltd., Japan

[21] Appl. No.: 614,315

[22] Filed: Mar. 12, 1996

[30] Foreign Application Priority Data

Apr. 20, 1995 [JP] Japan ..... 7-095097

[51] Int. Cl.[6] ..... G05F 3/20

[52] U.S. Cl. ..... 323/315; 323/316

[58] Field of Search ..... 323/312, 315, 323/316, 317; 326/66, 67, 69, 73, 74, 77, 78; 330/257, 288

[56] References Cited

U.S. PATENT DOCUMENTS 4,414,502 11/1983 Wong ..... 323/315
4,644,194 2/1987 Birrittella et al. ..... 323/315
4,684,831 8/1987 Kruest ..... 323/316
4,794,317 12/1988 Van Tran ..... 323/316
5,349,287 9/1994 Lorenz ..... 323/316

*Primary Examiner*—Matthew V. Nguyen
*Attorney, Agent, or Firm*—Majestic, Parsons, Siebert & Hsue

[57] ABSTRACT

An ECL output circuit includes an emitter differential pair of transistors, a positive voltage source connected to the collectors of this pair of transistors, a reference voltage source, a constant current supplying circuit, and an output circuit. The emitter differential pair of transistors has their emitters connected together, the base of one of them is connected to an input terminal where an input voltage is adapted to be applied, the reference voltage source is adapted to apply a reference voltage to the base of the other of the pair of transistors, and the positive voltage source is connected to their collectors.

7 Claims, 2 Drawing Sheets

EMITTER COUPLED LOGIC OUTPUT CIRCUIT

BACKGROUND OF THE INVENTION

This invention relates to an emitter coupled logic (herein referred to as ECL) output circuit.

FIG. 2 shows a prior art inverter circuit using an ECL circuit of this kind, formed with a current switch circuit comprising a pair of transistors Q21 and Q22 (herein referred to as an emitter differential pair 22) and an emitter follower output circuit comprising an output transistor Q23. The base of the transistor Q21 serves as an input terminal 26 where input voltage $V_{IN}$ is applied, and its collector is connected to a load resistor 21 of resistance $R_1$. A reference voltage $V_{REF}$ is applied through a reference voltage source 24 to the base of the transistor Q22. The collector of the transistor Q23 and the load resistor 21 are connected together to a voltage source terminal 27 at potential $V_{CC}$. A resistor 25 with resistance $R_2$ is connected to the emitter of the output transistor Q23, their joint serving as an output terminal 28 where output voltage $V_{OUT}$ is obtained. The emitters of the transistors Q21 and Q22 are connected together to a grounding terminal 29 (at voltage $V_{EE}$) through a constant current source 23 for providing a constant current $I_1$.

Logic output from the inverter circuit described above will be explained next.

When the input voltage $V_{IN}$ applied to the input terminal 26 is lower than the reference voltage $V_{REF}$ (or $V_{IN}<V_{REF}$), a constant current $I_1$ flows through the transistor Q22, but not through the load resistor 21. Thus, the output $V_{OUT1}$ at the output terminal 28 in this situation is given by:

$$V_{OUT1}=V_{CC}-V_{BEQ23} \quad (1)$$

where $V_{BEQ23}$ denote the voltage between the base and the emitter of the output transistor Q23. When the input voltage $V_{IN}$ is equal to the reference voltage $V_{REF}$ (or $V_{IN}=V_{REF}$), the constant current $I_1$ flows equally (one half each) through the transistors Q22 and Q23. Thus, the output voltage $V_{OUT2}$ at the output terminal in this situation is given by:

$$V_{OUT2}=V_{CC}-R_1I_1/2-V_{BEQ23} \quad (2)$$

When the input voltage $V_{IN}$ is greater than the reference voltage $V_{REF}$ (or $V_{IN}>V_{REF}$), the constant current $I_1$flows through the load resistor 21, but not through the transistor 23. Thus, the output voltage $V_{OUT3}$ in this situation is given by:

$$V_{OUT3}=V_{CC}-R_1I_1-V_{BEQ23} \quad (3)$$

From (1), (2) and (3) given above, the logic amplitude of the inverter circuit shown in FIG. 2 is obtained as follows:

$$V_{OUT1}-V_{OUT3}=R_1I_1 \quad (4)$$

This, however, is subject to the condition $R_1I_1<2\ V_{BEQ21}$ where $V_{BEQ21}$ is the voltage between the base and the emitter of the transistor Q21, if the saturation condition of the transistor Q21 is taken into consideration.

The threshold level $V_{TH0}$ is given by:

$$V_{TH0}=V_{REF}=V_{OUT2}=V_{CC}-R_1I_1/2-V_{BEQ23} \quad (5)$$

This means that the threshold level $V_{TH0}$ of the logic output in the case of an inverter circuit using a prior art ECL circuit depends on the voltage $V_{CC}$ at the voltage source terminal 27 and hence the circuit must be designed with reference to $V_{CC}$. In order to stabilize the logic operation, however, $V_{CC}$ must be stable, and it was necessary to provide $V_{CC}$ as the ground (GND) potential. This means that a negative voltage $V_{EE}$ must be applied to the grounding terminal 29, but this makes the interfacing difficult with other circuits driven by a positive voltage.

Moreover, since the logic amplitude given by (4) is subject to the condition $R_1I_1<2\ V_{BEQ21}$, the logic amplitude cannot be designed sufficiently freely, and it was necessary to take noise margin into consideration.

SUMMARY OF THE INVENTION

It is therefore an object of this invention to eliminate the problems of prior art circuits as described above by providing an emitter coupled logic output circuit which is capable of operating stably with a positive voltage source, which can be interfaced with other circuits driven by a positive voltage source, and of which the logic amplitude can be set with a relatively high degree of freedom.

An ECL output circuit embodying the present invention, with which the above and other objects can be accomplished, may be characterized as comprising an emitter differential pair of transistors, a positive voltage source connected to the collectors of this pair of transistors, a reference voltage source, a constant current supplying circuit, and an output circuit. The emitter differential pair of transistors has their emitters connected together, the base of one of them is connected to an input terminal where an input voltage is adapted to be applied, the reference voltage source is adapted to apply a reference voltage to the base of the other of the pair of transistors, and the positive voltage source is connected to their collectors. The constant current supplying circuit is for converting the reference voltage to a constant current corresponding to the inputted reference voltage and to supply this constant current to the emitters of the emitter differential pair of transistors. The output circuit comprises non-inversion transistors and inversion transistors arranged so as to provide a pair of current mirrors. The collector of each of the emitter differential pair of transistors being connected to different one of these non-inversion transistors of the output circuit. Each of the inversion transistors are connected to an output terminal for providing an output voltage.

According to a preferred embodiment of this invention, the constant current supplying circuit comprises a voltage-to-current conversion circuit for converting the reference voltage into a converted current which depends on said reference voltage and a constant current circuit comprising current mirrors which function to convert this converted current into the constant current and supplying the constant current to the mutually connected emitters of the emitter differential pair of transistors.

With a logic output circuit thus formed, a constant current is generated and supplied to the commonly connected emitters of the emitter differential pair generates on the basis of the reference voltage applied to the base of one of the pair of transistors. The output from this emitter differential pair, according to an input voltage inputted at the input terminal, is passed through the output circuit with a pair of current mirrors and obtained as output voltage at the output terminal.

With a constant current supplying circuit formed as described above, the constant current to be supplied to the emitter differential pair of transistors is obtained as an inversion current through a transistor which forms a current mirror in the constant current circuit.

If the present invention is applied to an inverter circuit, for example, its logic amplitude depends on a reference voltage, not only the source voltage, and is independent of the saturation condition of the emitter differential pair of transistors. As a result, the logic amplitude can be designed with a large degree of freedom. Since the threshold level is determined also by the reference voltage and independently of the source voltage, furthermore, the grounding terminal can be maintained at the ground potential such that a positive source voltage can be used for the inverter circuit, making it possible to interface it with other circuits driven by a positive voltage source.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
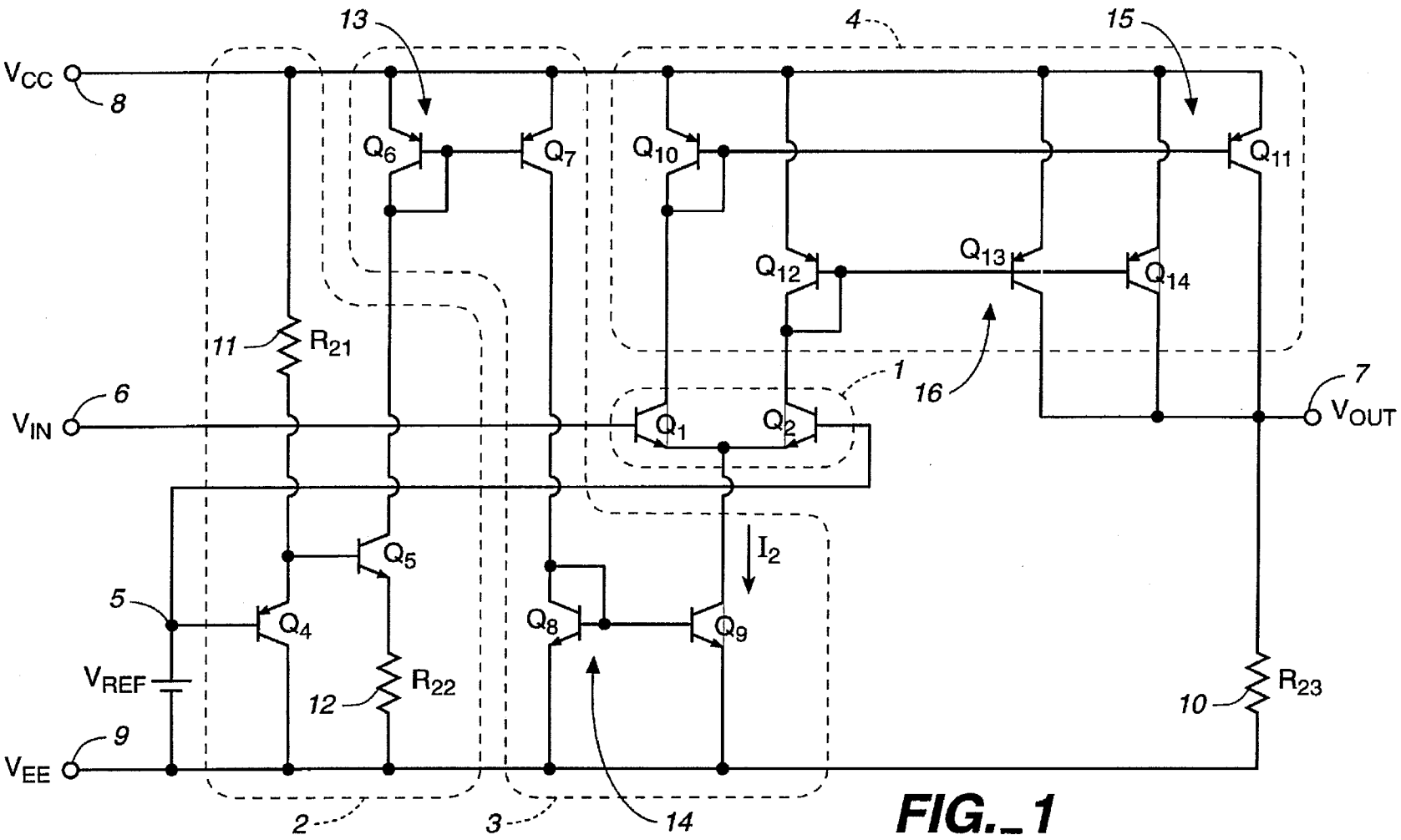
FIG. 1 is a circuit diagram of an inverter circuit using an ECL circuit embodying this invention.
Figure 2:
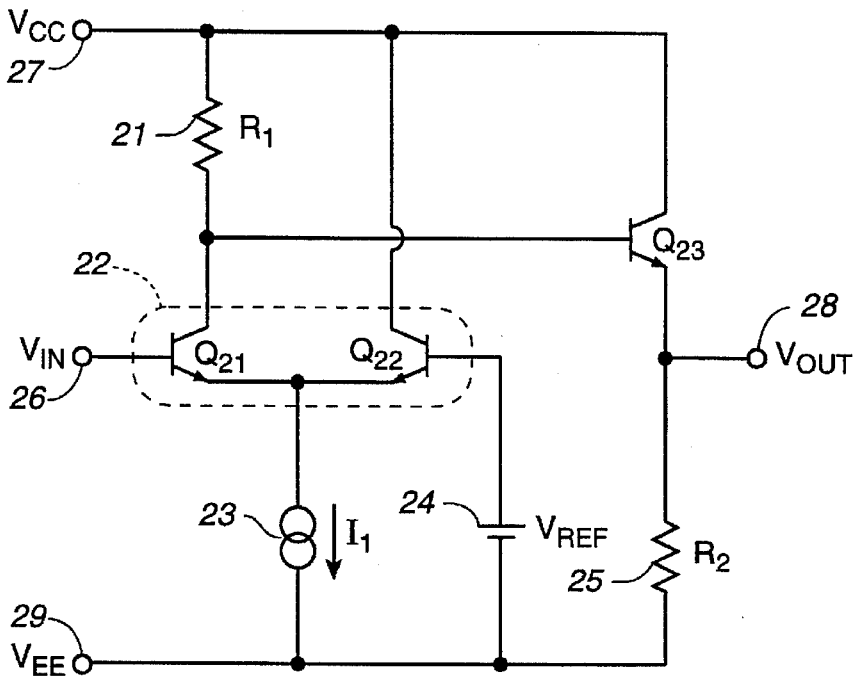
FIG. 2 (PRIOR ART)
FIG. 2 is a circuit diagram of a prior art ECL inverter circuit.

The invention is described next by way of an example with reference to FIG. 1 which shows an inverter circuit using an ECL circuit embodying this invention. This inverter circuit comprises a current switching circuit composed of an emitter differential pair 1, a voltage-to-current conversion circuit 2 (hereinafter referred to simply as "the conversion circuit") and a constant current circuit 3, as well as an output circuit 4. The emitter differential pair 1 is composed of transistors Q1 and Q2 with the base of transistor Q1 connected to an input terminal 6 (where an input voltage $V_{IN}$ is applied). A reference voltage source (symbolically indicated in FIG. 1 by numeral 5) is connected between the base of transistor Q2 and a grounding line leading to a grounding terminal 9 (where terminal voltage $V_{EE}$ is applied) and serves to apply a reference voltage $V_{REF}$ to the base of transistor Q2.

Figure 3:
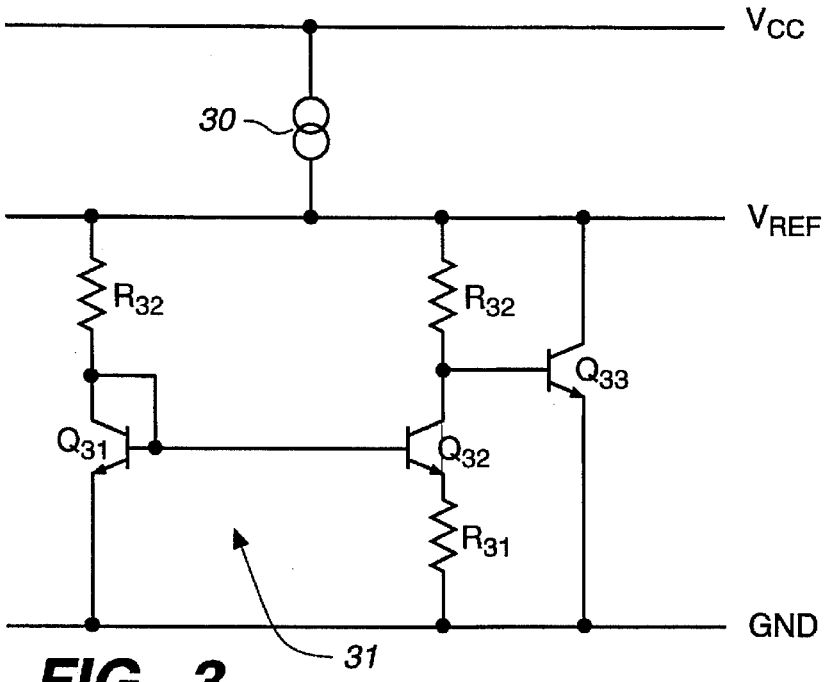
FIG. 3 is a circuit diagram of a reference voltage generating circuit for an inverter circuit using an ECL circuit embodying this invention.

According to a preferred embodiment of the invention, the reference voltage $V_{REF}$ is provided as a constant voltage from a constant voltage circuit shown, for example, in FIG. 3 such that the outputted reference voltage will not be influenced by temperature variations or fluctuations in production processes. The constant voltage circuit of FIG. 3 is an ordinary band gap voltage generating circuit, comprising a constant current source 30, an emitter-follower with output stage transistor Q33 (hereinafter referred to simply as "the output stage transistor") and a current mirror circuit 31 (also referred to as "reference-voltage-providing current mirror) with transistor pair Q31 and Q32. Each of this transistor pair Q31 and Q32 has its collector connected to one end of a resistor R32 (with resistance $R_{32}$), the other end the resistors R32 being connected, each of the resistors R32 between the collector of the corresponding transistor Q31 or Q32 and one end of the constant current source 30. Another resistor R31 (with resistance $R_{32}$) is connected between the emitter of transistor Q32 and the ground (GND) level. Collector voltage of transistor Q32 is applied to the base of the output stage transistor Q33. With a current mirror circuit 31 thus formed, a reference voltage $V_{REF}$ can be obtained as a band gap voltage by setting a thermoelectric voltage $V_T$ having a positive temperature coefficient, causing base-emitter voltage $V_{BEQ33}$ of the output stage transistor Q33 to have a negative temperature coefficient, and adding them appropriately. Explained more in detail, since the reference voltage $V_{REF}$ in this case is given by $V_{REF}=V_{BEQ33}+(R_{32}/R_{31})V_T\ln N$ where N is the current inversion ratio of the current mirror circuit 31, it is possible to reduce or eliminate the influence of process fluctuations on the reference voltage $V_{REF}$, for example, by producing the two resistors R31 and R32 from the same material in the same production process and disposing adjacent to each other.

The conversion circuit 2 comprises input transistor Q4, to the base of which is applied the reference voltage $V_{REF}$ from the reference voltage source 5, and an emitter-follower with output transistor Q5, to the base of which is connected the collector of transistor Q4. The collector of transistor Q4 is connected through a resistor 11 (with resistance $R_{21}$) to a source line of a source terminal 8, to which is applied a positive source voltage $V_{CC}$. The emitter of transistor Q5 is connected through a resistor 12 (with resistance $R_{22}$) to a grounding line of a grounding terminal 9 (at voltage $V_{EE}$). The reference voltage $V_{REF}$ is converted into a current by means of this voltage-current conversion circuit 2, this converted current $I_2$ being given by $I_2=V_{REF}/R_{22}$ and supplied to the common emitter of the emitter differential pair 1 through the constant current circuit 3.

The constant current circuit 3 is composed of two current mirror circuits 13 and 14. Current mirror circuit 13 comprises a transistor pair Q6 (non-inversion) and Q7 (inversion). The collector of transistor Q6, the base and collector of which are connected together, is connected to the collector of output transistor Q5 of the conversion circuit 2. Current mirror circuit 14 comprises a transistor pair Q8 (non-inversion) and Q9 (inversion). The collector of transistor Q8, the base and collector of which are connected together, is connected to the collector of transistor Q7 on the inversion side of current mirror circuit 13. The collector of transistor Q9 on the inversion side of current mirror circuit 14 is connected to the common emitter of the emitter differential pair 1. The emitters of the transistor pair Q6 and Q7 of current mirror circuit 13 are connected to the source line of the source terminal 8, and the emitters of the transistor pair of current mirror circuit 14 are connected to the grounding line of the grounding terminal 9. The aforementioned constant current 12 is supplied to the emitter differential pair 1 and transistor Q9 through the conversion circuit 2 and the constant current circuit 3.

The output circuit 4 comprises two current mirror circuits 15 and 16. Current mirror circuit 15, of which the current inversion ratio n is equal to 1, comprises non-inversion transistor Q10, the base and the emitter of which are connected together, and inversion transistor Q11. The collector of transistor Q10 is connected to the collector of transistor Q1 of the emitter differential pair 1. Current mirror circuit 16, of which the current inversion ratio m is equal to 2, comprises non-inversion transistor 12, of which the base and the emitter are connected together, and inversion transistors Q13 and Q14. The collector of transistor Q12 is connected to the collector of transistor Q2 of the emitter differential pair 1. The collectors of inversion transistors Q11, Q13 and Q14 are each connected to the grounding line through resistor 10 (with resistance $R_{23}$), their junction therewith being connected to an output terminal 7 (output voltage being indicated as $V_{OUT}$).

The logic output operation by the inverter circuit described above will be explained next.

When the input voltage $V_{IN}$ applied to the input terminal 6 is smaller than the reference voltage $V_{REF}$ (or when $V_{IN}<V_{REF}$), the constant current $I_2$ does not flow through transistor Q1 but does flow through transistor Q2. Since current mirror circuit 16 in this situation causes an inversion current with intensity m times greater to flow through resistor 10, the output voltage at the output terminal 7 is a high-level output voltage given by:

$$V_{OUTH}=mR_{23}I_2 \quad (A)$$

When the input voltage $V_{IN}$ is greater than the reference voltage $V_{REF}$ (or when $V_{IN}>V_{REF}$), the constant current $I_2$ does not flow through transistor Q2 but does flow through transistor Q1. Since current mirror circuit 15 in this situation causes an inversion current with intensity n times greater (but m>n) to flow through resistor 10, the output voltage in this situation is a low-level output voltage give by:

$$V_{OUTL}=nR_{23}I_2 \quad (B)$$

When the input voltage $V_{IN}$ is equal to the reference voltage $V_{REF}$ (or when $V_{IN}=V_{REF}$), the constant current $I_2$ flows through both transistors Q1 and Q2, evenly split therebetween. Thus, the output voltage in this situation is given by:

$$V_{OUTE}=(m+n)R_{23}I_2/2 \quad (C)$$

From the relationships (A), (B) and (C), one obtains the logic amplitude of the inverter circuit as follows:

$$V_{OUTH}-V_{OUTL}=(m-n)R_{23}I_2 \quad (D)$$

and the threshold level $V_{TH}$ is given by:

$$V_{TH}=V_{REF}=V_{OUTE}=(m+n)R_{23}I_2/2 \quad (E)$$

If m=2 and n=1, the logic amplitude is given by:

$$V_{OUTH}-V_{OUTL}=R_{23}I_2=V_{REF}R_{23}/R_{22} \quad (F)$$

and the threshold level is given by:

$$V_{TH}=V_{REF}=V_{OUTE}=3\ V_{REF}R_{23}/2R_{22} \quad (G)$$

because $I_2=V_{REF}/R_{22}$.

It is clear from (F) that the logic amplitude according to this embodiment of the invention depends only on the reference voltage $V_{REF}$ and the resistance values $R_{22}$ and $R_{23}$. Since the emitter differential pair 1 does not include a load resistance, furthermore, the logic amplitude is not subjected to the transistor saturation condition of this differential pair. According to this embodiment of the invention, therefore, the logic amplitude can be designed with a relatively large degree of freedom by forming the resistors 10 and 12 from the same material by the same layout by an ordinary production process for semiconductor integrated circuits without adverse effects of the fluctuations in the production processes or temperature variations. Design of noise margin can also be simplified. If the resistors 10 and 12 are disposed adjacent to each other, furthermore, such adverse effects can be eliminated even more effectively and optimal logic amplitude can be thereby designed.

One also learns from (G) that the threshold level $V_{TH}$ of the logic output depends also only on the resistance values $R_{22}$ and $R_{23}$ and the reference voltage $V_{REF}$. In other words, the threshold value $V_{TH}$ has nothing to do with the positive voltage $V_{CC}$ but is determined on the basis of the reference voltage $V_{REF}$. Thus, the voltage $V_{EE}$ of the grounding terminal can be the ground (GND) level potential, and the inverter circuit can be operated by applying a positive voltage $V_{CC}$ at the source terminal 8 without causing any problem when interfacing with any other circuit driven by a positive voltage source.

Although this invention relating to an ECL circuit was described above with reference to only one inverter circuit, it is not intended to limit the scope of the invention. An ECL circuit according to this invention can be used in connection with logic output circuits of many other kinds. Disclosure in the specification is intended to be interpreted broadly, and any modifications and variations of the disclosure presented above, that may be apparent to a person skilled in the art, are intended to be within the scope of the invention.

What is claimed is:

1. An emitter coupled logic output circuit comprising:

an input terminal for having an input voltage applied thereon;

an emitter differential pair of transistors (Q1) and (Q2) each having a base, a collector and an emitter, the emitters of said transistors (Q1) and (Q2) being connected together, and the base of said transistor (Q1) being connected to said input terminal;

a positive voltage source connected to the collectors of said transistors (Q1) and (Q2);

a reference voltage source adapted to apply a reference voltage to the base of said transistor (Q2);

a constant current supplying circuit adapted to convert said reference voltage to a constant current corresponding to said reference voltage and to supply said constant current to the emitters of said transistors (Q1) and (Q2);

an output terminal for providing an output voltage; and an output circuit comprising non-inversion transistors and inversion transistors arranged so as to provide a pair of output-circuit current mirrors, the collector of each of said transistors (Q1) and (Q2) being connected to different one of said non-inversion transistors of said output circuit, each of said inversion transistors being connected to said output terminal.

2. The emitter coupled logic output circuit of claim 1 wherein said constant current supplying circuit comprises:

a voltage-to-current conversion circuit for converting said reference voltage into a converted current which depends on said reference voltage; and a constant current circuit comprising current mirrors which function to convert said converted current into said constant current and supplying said constant current to the mutually connected emitters of said transistors (Q1) and (Q2).

3. The emitter coupled logic output circuit of claim 2 wherein said constant current circuit includes an inversion transistor which serves to output said constant current as inversion current.

4. The emitter coupled logic output circuit of claim 1 structured such that the difference in said output voltage between when said input voltage is higher than said reference voltage and when said input voltage is lower than said reference voltage is independent of the voltage of said positive voltage source.

5. The emitter coupled logic output circuit of claim 1 wherein said output-circuit current mirrors have different current inversion ratios.

6. The emitter coupled logic output circuit of claim 1 wherein said reference voltage source comprises:

a reference-voltage-providing current mirror having a pair of transistors (Q31) and (Q32) each having a base, a collector and an emitter;

an emitter-follower with output stage transistor Q33 having base thereof connected to the connector of said transistor (Q32);

a constant current source;

a pair of resistors (R32) each connected between one end of said constant current source and the connector of different one of said transistors (Q31) and (Q32); and another resistor (R31) connected to the emitter of said transistor Q32.

7. The emitter coupled logic output circuit of claim 2 wherein said reference voltage source comprises:

a reference-voltage-providing current mirror having a pair of transistors (Q31) and (Q32) each having a base, a collector and an emitter;

an emitter-follower with output stage transistor (Q33) having base thereof connected to the connector of said transistor (Q32);

a constant current source;

a pair of resistors (R32) each connected between one end of said constant current source and the connector of different one of said transistors (Q31) and (Q32); and another resistor (R31) connected to the emitter of said transistor Q32.

* * * * *